United States Patent [19]

Jones et al.

[11] Patent Number: 4,974,357

[45] Date of Patent: Dec. 4, 1990

[54] SPEED LOADING DEVICE FOR A MUZZLE LOADING FIREARM

[76] Inventors: Laurance D. Jones, 5097 W. Wilson Rd.; Sylvester J. Neeley, 5093 W. Wilson Rd., both of Clio, Mich. 48420

[21] Appl. No.: 432,907

[22] Filed: Nov. 7, 1989

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 163,404 | 5/1875 | Phillips | 42/90 |
| 871,355 | 11/1907 | Morlan | 42/87 |
| 3,520,400 | 7/1970 | Gates | 42/87 |
| 3,956,844 | 5/1976 | Misevich et al. | 42/90 |
| 4,112,606 | 9/1978 | Griffin | 42/90 |
| 4,152,858 | 5/1979 | Dobbs | 42/90 |
| 4,193,347 | 3/1980 | Stier et al. | 42/88 |
| 4,373,285 | 2/1983 | Grout et al. | 42/90 |
| 4,466,209 | 8/1984 | Strickland et al. | 42/90 |
| 4,536,983 | 8/1985 | Fry | 42/90 |
| 4,601,125 | 7/1986 | Curtis | 42/90 |
| 4,756,110 | 7/1988 | Beltron | 42/87 |
| 4,862,623 | 9/1989 | Delap et al. | 42/90 |
| 4,875,303 | 10/1989 | DeWeert et al. | 42/90 |

*Primary Examiner*—Charles T. Jordan
*Assistant Examiner*—Michael J. Carone
*Attorney, Agent, or Firm*—Jerry T. Kearns

[57] ABSTRACT

A speed loading device for a black powder muzzle loading firearm includes an elongated hollow cylindrical tube. A cylindrical cap is removably secured on a first end of the tube and is dimensiones to hold a single powder charge. A cylindrical guide member is removably secured on a second end of the tube, opposite the cap and includes a central circular aperture through which a cylindrical rod is slidably received. A plunger is secured on an end of the rod within the tube. A safety latch mechanism is provided for preventing axial movement of the plunger, when not in use. The device allows the rapid loading of a powder charge and a ball and patch into a muzzle loading firearm.

6 Claims, 3 Drawing Sheets

SPEED LOADING DEVICE FOR A MUZZLE LOADING FIREARM

BACKGROUND OF THE INVENTION

1. Field of the Invention

The present invention relates to speed loading devices, and more particularly pertains to a speed loading device for use with muzzle loading black powder firearms of the type in which a powder charge, a patch and a ball are loaded.

2. Description of the Prior Art

Various types of speed loading devices are known in the prior art. A typical example of such a speed loading device is to be found in U.S. Pat. No. 871,355, which issued to E. Morlan on Nov. 19, 1907. This patent discloses a tubular magazine for loading cartridges into the britch of a rifle. A reciprocal plunger is utilized to load individual cartridges. U.S. Pat. No. 3,520,400, which issued to D. Gates on July 14, 1970, discloses an ammunition package in which multiple rounds are packaged in axial alignment in tubular plastic containers. U.S. Pat. No. 3,956,844, which issued to K. Misevich et al of May 18, 1976, discloses a loading device in which a plurality of tubular projectiles are held in a cylindrical container. A stem is withdrawn from one end of the container until it engages a plunger. After the other end of the container is placed in a launcher, the stem is pushed into the container forcing the plunger to move the projectiles toward the launcher. U.S. Pat. No. 4,193,347, which issued to O. Stier et al on Mar. 18, 1980, discloses caseless ammunition having cartridges consisting of a bullet, a charge and a detonator. Tongue and groove interfitting faces of the cartridges cooperate to form a cartridge stack which is held in a magazine. U.S. Pat. No. 4,756,110, which issued to J. Beltron on July 12, 1988, disclose a shotgun speed loader for storing shotgun shells and depositing shells into a shotgun magazine. The loader includes a flexible tube having an elongated slot which snugly holds the shells, but which permits rapid discharge of the shells upon movement of a plunger travelling within the slot.

While the above mentioned devices are directed to various speed loading devices, none of these devices disclose a speed loading device suitable for use with a muzzle loading firearm. Inasmuch as the art is relatively crowded with respect to these various types of speed loading devices, it can be appreciated that there is a continuing need for and interest in improvements to such speed loading devices, and in this respect, the present invention addresses this need and interest.

SUMMARY OF THE INVENTION

In view of the foregoing disadvantages inherent in the known types of speed loading devices now present in the prior art, the present invention provides an improved speed loading device for a muzzle loading firearm. As such, the general purpose of the present invention, which will be described subsequently in greater detail, is to provide a new and improved speed loading device for a muzzle loading firearm which has all the advantages of the prior art speed loading devices and none of the disadvantages.

To attain this, a representative embodiment of the concepts of the present invention is illustrated in the drawings and makes use of a speed loading device for a black powder muzzle loading firearm which includes an elongated hollow cylindrical tube. A cylindrical cap is removably secured on a first end of the tube and is dimensioned to hold a single powder charge. A cylindrical guide member is removably secured on a second end of the tube, opposite the cap and includes a central circular aperture through which a cylindrical rod is slidably received. A plunger is secured on an end of the rod within the tube. A safety latch mechanism is provided for preventing axial movement of the plunger, when not in use. The device allows the rapid loading of a powder charge and a ball and patch into a muzzle loading firearm.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved speed loading device for a muzzle loading firearm which has all the advantages of the prior art speed loading devices and none of the disadvantages.

It is another object of the present invention to provide a new and improved speed loading device for a muzzle loading firearm which may be easily and efficiently manufactured and marketed.

It is a further object of the present invention to provide a new and improved speed loading device for a muzzle loading firearm which is of a durable and reliable construction.

An even further object of the present invention is to provide a new and improved speed loading device for a muzzle loading firearm which is susceptible of a low cost of manufacture with regard to both materials and labor, and which accordingly is then susceptible of low prices of sale to the consuming public, thereby making such speed loading devices economically available to the buying public.

Still yet another object of the present invention is to provide a new and improved speed loading device for a muzzle loading firearm which provides in the apparatuses and methods of the prior art some of the advantages thereof, while simultaneously overcoming some of the disadvantages normally associated therewith.

Still another object of the present invention is to provide a new and improved speed loading device for a muzzle loading firearm to enable a precise powder charge to be rapidly loaded.

Yet another object of the present invention is to provide a new and improved speed loading device for a muzzle loading firearm which enables a patch and ball to be rapidly aligned and loaded into the barrel of a firearm.

Even still another object of the present invention is to provide a new and improved speed loading device for a muzzle loading firearm which includes an axially movable plunger for initially inserting a ball and patch into the barrel of a firearm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
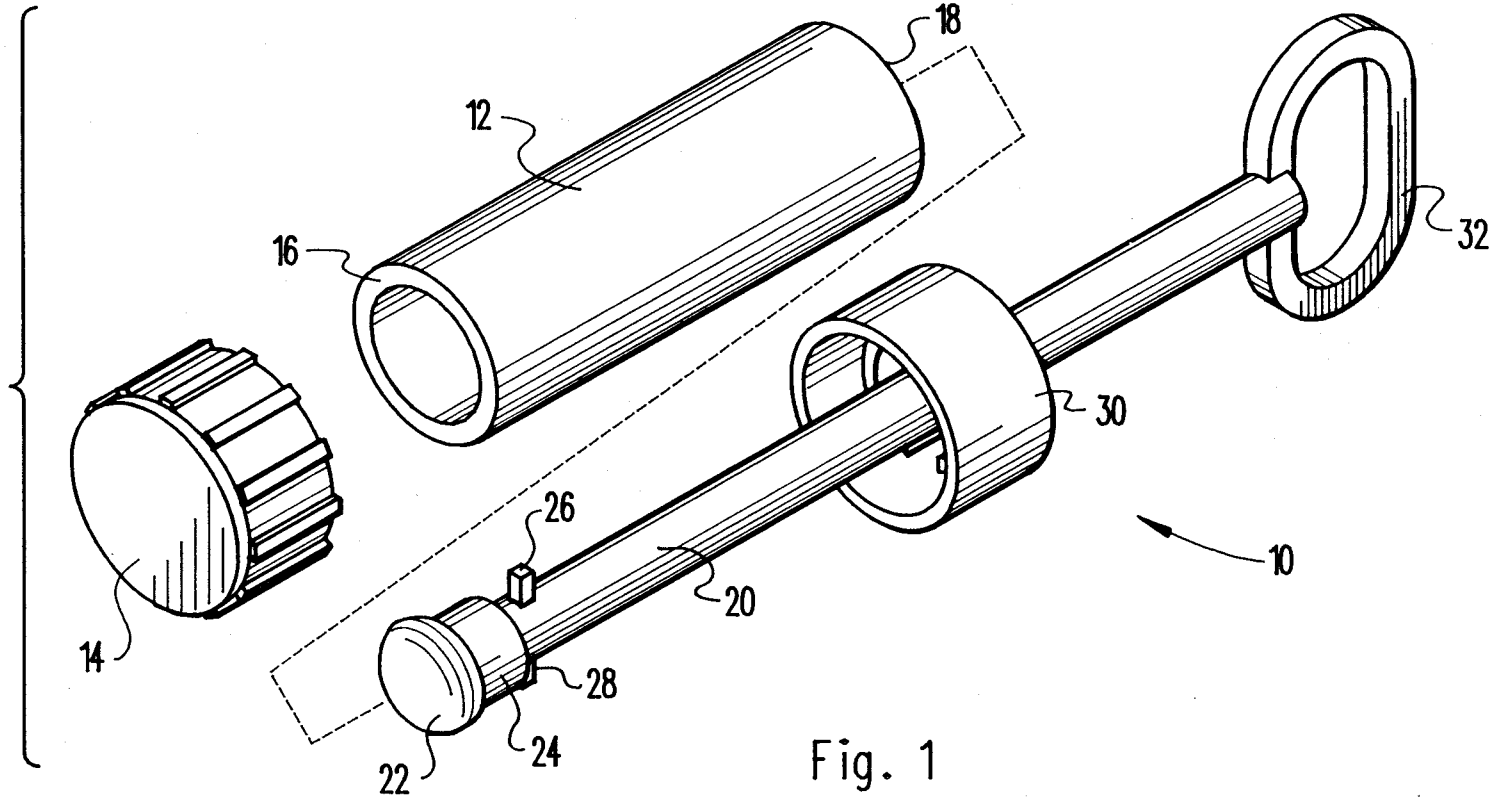
FIG. 1 is an exploded perspective view of the speed loading device of the present invention.

With reference now to the drawings, and in particular to FIG. 1 thereof, a new and improved speed loading device for a muzzle loading firearm embodying the principles and concepts of the present invention and generally designated by the reference numeral 10 will be described.

More specifically, it will be noted that the first embodiment 10 of the invention includes an elongated hollow cylindrical tube 12. A cylindrical cap 14 is removably secured on a first end 16 of the tube 12. The cap 14 is dimensioned to hold a single powder charge. It should be noted that the various components of the speed loader of the present invention may be formed in a variety of different sizes for use with various different types and calibers of firearms. A cylindrical guide member 30 is removably secured on a second end 18 of the tube 12, opposite the cap 14. The removable connection between the tube 12, the cap 14 and the guide member 30 may be effected by a slip friction fit, or through the use of threaded connections. A central circular aperture is formed through the top end face of the guide member 30 and receives a cylindrical rod 20. The rod 20 is mounted for sliding axial reciprocal movement within the tube 12. A plunger 22 has a hollow cylindrical socket portion 24 which receives and is secured to an end portion of the rod 20. A pair of diametrically opposite lateral tabs 26 and 28 extend radially outwardly from the rod 20, adjacent the plunger 22. A transverse handle 32 is secured on an external end of the rod 20, opposite the plunger 22. The transverse handle 32 is preferably disposed in a predetermined angular orientation with the tabs 26 and 28 to enable an individual to readily ascertain the relative angular position of the tabs 26 and 28.

Figure 2:
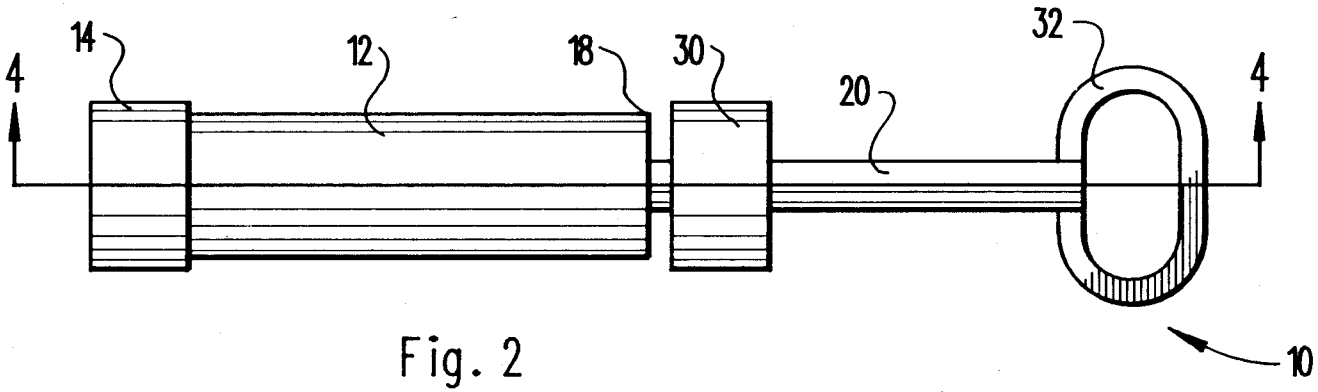
FIG. 2 is a side view illustrating the speed loading device of the present invention.

FIG. 2 is a side view illustrating the speed loading device 10. It should be noted that the guide member 30 is illustrated slightly spaced from the end 18 of the tube 12.

Figure 3:
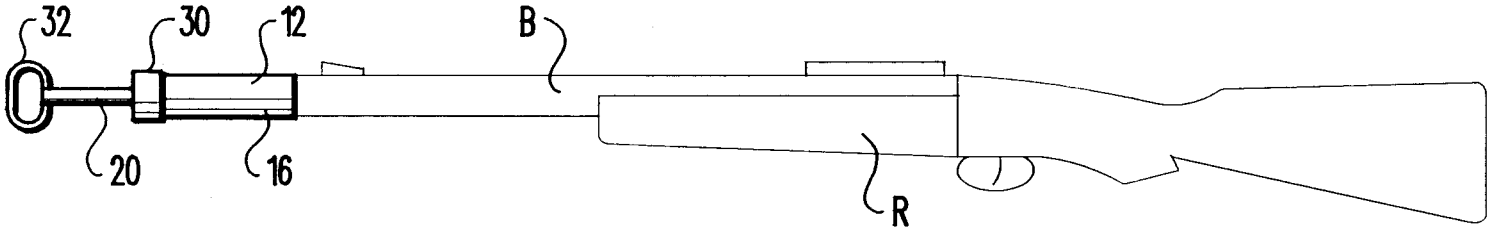
FIG. 3 is a side view illustrating the manner of use of the speed loading device of the present invention.

With respect to FIG. 3, the manner of use of the speed loader of the present invention will now be described. The powder cap 14 (not shown) has been initially removed from the tube 12 and a powder charge received therein has been poured into the barrel B of a muzzle loading rifle R. After the powder charge has been loaded, the now open end 16 of the tube 12 is placed into coaxial alignment with the barrel B. The tube 12 contains a patch ball, of a conventional type, which is now loaded into the barrel B, through the open end 16, by an individual depressing the handle 32 and attached plunger rod 20. This causes the internal plunger 22 (FIG. 1) to force the patch and ball into the barrel B. Subsequent to this operation, the rifle ram rod (not shown) is utilized to ram the patch ball and powder charge into the proper position within the barrel B. The use of the rifle ram rod and its construction are conventional, and form no part of the present invention.

Figure 4:
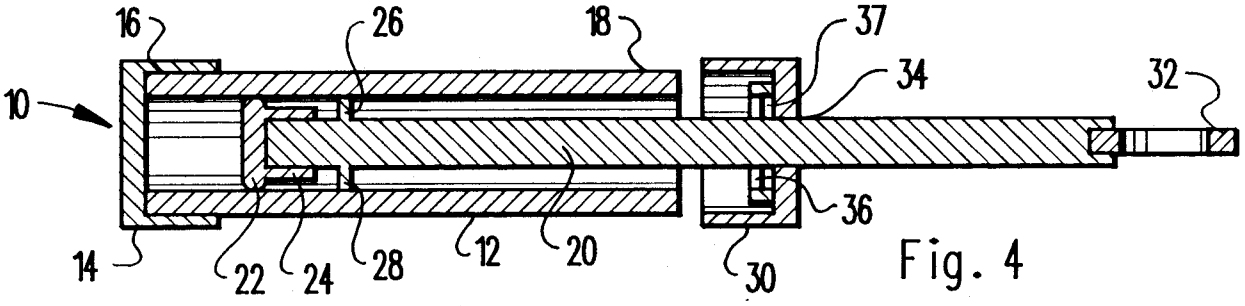
FIG. 4 is a longitudinal cross sectional view, taken along line 4—4 of FIG. 2.

FIG. 4 is a longitudinal cross sectional view of the speed loading device 10, taken along line 4—4 of FIG. 2. The plunger 22 is received in close fitting relation within the hollow interior of the tube 12 The guide member 30 may be removed from the top end 18 of the tube 12 to allow insertion of a new powder charge, ball and patch. The guide member 30 includes a central circular aperture 34 through which the plunger rod 20 is slidably received. An internal cylindrical boss 36 surrounds the rod 20 and includes an undercut circular groove 37.

Figure 5:
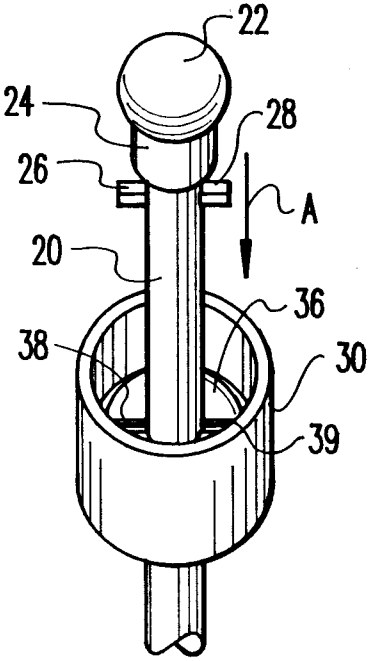
FIG. 5 is a perspective detail view illustrating the plunger safety latch mechanism of the speed loading device of the present invention.

As shown in FIG. 5, the boss 36 within the guide member 30 includes a pair of diametrically opposed notches 38 and 39 dimensioned to receive the tabs 26 and 28 secured to the rod 20.

Figure 6:
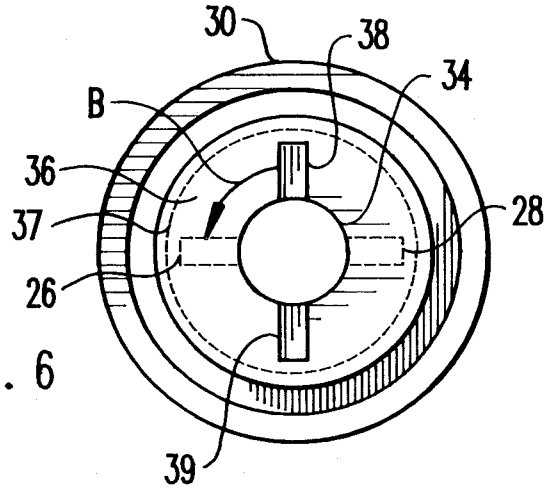
FIG. 6 is a plan detail view, further illustrating the construction of the safety latch mechanism.

As shown in FIG. 6, the notches 38 and 39 communicate with the interior undercut groove 37. This allows the tabs 26 and 28 to be retracted into the notches 38 and 39 as indicated by arrow A shown in FIG. 5. After the tabs 26 and 28 are located within the notches 38 and 39, rotation of the handle 32 and attached plunger rod 20 (FIG. 1) causes the tabs 26 and 28 to be rotated within the groove 37 to the positions illustrated in phantom line, as indicated by arrow B in FIG. 6. As will now be understood, the tabs 26 and 28 are now captured within the boss 36, thus preventing axial movement of the plunger rod 20. This provides a safety latch mechanism which prevents inadvertent displacement of the plunger prior to a loading operation.

It is contemplated that the various components of the present invention may be formed from a non-magnetic metal material, or from a plastic material. The device may be inexpensively formed such that a plurality may be carried to afford a large number of quick reloads.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A speed loading device for a muzzle loading firearm, comprising:

an elongated hollow tube;

a cap removably secured on a first end of said tube, said cap dimensioned to hold a single powder charge;

a guide member removably secured on a second end of said tube, opposite said cap;

a rod mounted through said guide member for reciprocal axial movement within said tube;

a plunger secured on an end of said rod within said tube;

a handle secured on an external end of said rod, opposite said plunger;

and latch means for selectively securing said plunger against axial movement.

2. The speed loading device for a muzzle loading firearm of claim 1, wherein said latch means comprises:

a pair of diametrically opposed lateral tabs extending radially outwardly from said rod, adjacent said plunger.

3. The speed loading device for a muzzle loading firearm of claim 2, further comprising:

an internal boss on said guide member;

and an undercut groove formed in said boss in coaxial surrounding relation with said rod.

4. The speed loading device for a muzzle loading firearm of claim 3, further comprising:

a pair of diametrically opposed notches formed in said boss on opposite sides of said rod, said notches dimensioned to receive said tabs and communicating with said groove.

5. The speed loading device for a muzzle loading firearm of claim 4, wherein said handle comprises a transverse handle secured on an external end of said rod, opposite said plunger, in a predetermined angular orientation with said tabs, whereby said tabs may be selectively locked within said boss to prevent axial movement of said plunger by rotation of said handle.

6. A speed loading device for a muzzle loading firearm, comprising:

an elongated hollow cylindrical tube;

a cylindrical cap removably secured on a first end of said tube, said cap dimensioned to hold a single powder charge;

a cylindrical guide member removably secured on a second end of said tube, opposite said cap;

a central circular aperture formed through said guide member;

a cylindrical rod received through said aperture for sliding axial reciprocal movement within said tube;

a plunger secured on an end of said rod within said tube;

a pair of diametrically opposed lateral tabs extending radially outwardly from said rod, adjacent said plunger;

an internal boss on said guide member;

an undercut groove formed in said boss in coaxial surrounding relation with said aperture;

a pair of diametrically opposed notches formed in said boss on opposite sides of said aperture, said notches dimensioned to receive said tabs and communicating with said groove;

and a transverse handle secured on an external end of said rod, opposite said plunger, in a predetermined angular orientation with said tabs, whereby said tabs may be selectively locked within said boss to prevent axial movement of said plunger by rotation of said handle.

* * * * *